US010126100B2

(12) United States Patent
Bonen

(10) Patent No.: US 10,126,100 B2
(45) Date of Patent: Nov. 13, 2018

(54) MISSILE SYSTEM INCLUDING ADS-B RECEIVER

(71) Applicant: ISRAEL AEROSPACE INDUSTRIES LTD., Lod (IL)

(72) Inventor: Uri Bonen, Hod-Hasharon (IL)

(73) Assignee: ISRAEL AEROSPACE INDUSTRIES LTD., Lod (IL)

( * ) Notice: Subject to any disclaimer, the term of this patent is extended or adjusted under 35 U.S.C. 154(b) by 304 days.

(21) Appl. No.: 15/025,840

(22) PCT Filed: Oct. 6, 2014

(86) PCT No.: PCT/IL2014/050873
§ 371 (c)(1),
(2) Date: Mar. 29, 2016

(87) PCT Pub. No.: WO2015/052707
PCT Pub. Date: Apr. 16, 2015

(65) Prior Publication Data
US 2016/0216073 A1 Jul. 28, 2016

(30) Foreign Application Priority Data
Oct. 8, 2013 (IL) ..... 228789

(51) Int. Cl.
*F41G 7/00* (2006.01)
*F42B 15/10* (2006.01)

(52) U.S. Cl.
CPC ..... *F41G 7/007* (2013.01)

(58) Field of Classification Search
CPC . F41G 7/007; F41G 3/02; G01S 3/043; G01S 3/46; G01S 13/78; G01S 13/91; G01S 13/42; G08G 5/0013; G08G 5/0026
See application file for complete search history.

(56) References Cited

U.S. PATENT DOCUMENTS 4,020,489 A * 4/1977 Bishop ..... G01S 13/78 342/45
4,136,340 A * 1/1979 Bishop ..... G01S 13/78 342/45

(Continued)

FOREIGN PATENT DOCUMENTS

CA 2437374 2/2004
CN 100541555 9/2009

(Continued)

OTHER PUBLICATIONS

International Search Report and Written Opinion from PCT/IL2014/050873 dated Feb. 17, 2015.

(Continued)

*Primary Examiner* — Bernarr E Gregory
(74) *Attorney, Agent, or Firm* — Dorsey & Whitney LLP

(57) ABSTRACT

The disclosure presents at least one example of a missile system, method, and/or computer program product. The missile system may, for example, include a radar, an Automatic Dependent Surveillance Broadcast ("ADS-B") receiver, a missile launcher, and a control station. The missile system may, for example, be configured to handle various situations such as when only ADS-B data relating to an airborne entity is available, only radar data relating to the airborne entity is available or both ADS-B data and radar data relating to the airborne entity are available. The missile system, may, for example, be a surface to air missile system.

20 Claims, 2 Drawing Sheets

(56) References Cited

U.S. PATENT DOCUMENTS

| | | | | |
|---|---|---|---|---|
| 4,843,459 | A | 6/1989 | Perrin et al. | |
| 5,347,910 | A | 9/1994 | Avila et al. | |
| 5,381,140 | A * | 1/1995 | Kuroda | G08G 5/0013 340/961 |
| 6,567,037 | B1 * | 5/2003 | Fung | G01S 13/91 342/29 |
| 6,573,858 | B1 * | 6/2003 | Fung | G01S 13/91 342/36 |
| 7,782,246 | B2 * | 8/2010 | McGuire | F41G 7/007 342/113 |
| 7,876,259 | B2 * | 1/2011 | Schuchman | G08G 5/0013 342/36 |
| 7,880,667 | B2 * | 2/2011 | Lanzkron | G01S 3/46 342/165 |
| 8,037,798 | B2 * | 10/2011 | Lance | F41G 7/007 102/501 |
| 8,207,480 | B2 * | 6/2012 | Lance | F41G 7/007 102/504 |
| 8,368,584 | B2 | 2/2013 | Askelson et al. | |
| 8,386,175 | B2 | 2/2013 | Limbaugh et al. | |
| 8,437,956 | B2 | 5/2013 | Limbaugh et al. | |
| 9,465,104 | B2 * | 10/2016 | Margolin | G01S 13/42 |
| 2008/0211709 | A1 * | 9/2008 | Smith | G08G 5/0026 342/32 |
| 2009/0308923 | A1 * | 12/2009 | Cornett | F41G 3/02 235/400 |
| 2010/0315281 | A1 | 12/2010 | Askelson et al. | |
| 2014/0327581 | A1 * | 11/2014 | Murphy | G01S 3/043 342/417 |

FOREIGN PATENT DOCUMENTS

| | | |
|---|---|---|
| EP | 1293799 | 9/2002 |
| EP | 1394495 | 3/2004 |

OTHER PUBLICATIONS

Borrelli, G. S. ADS-B to Link-16 Gateway Demonstration: An Investigation of a Low-Cost ADS-B Option for Military Aircraft, 2004, pp. 1-9.

"How It Works", Flightradar24.com Live flight tracker, Jun. 19, 2013.

Phelps, Mark. http://www.flyingmag.com/news/drone-tests-ads-b-based-sense-and-avoid-technology, "Drone Tests ADS-B-Based 'Sense-and-Avoid' Technology", Oct. 25, 2012.

Boyd, C. S., Collyer, R. S., Skinner, D. J., Smeaton, A. E., Wilson, S. A., Krause, D. W., . . . & Godfrey, J. (Nov. 2005,). "Characterization of Combat identification Technologies". In IEEE International Region 10 Conference (pp. 568-573).

* cited by examiner

MISSILE SYSTEM INCLUDING ADS-B RECEIVER

TECHNICAL FIELD

The disclosure relates to a missile system.

BACKGROUND

In a missile system, it is desirable to detect a potentially hostile airborne entity. It is also desirable to launch a missile against the entity if the entity is indeed hostile (also known as foe), and not to launch a missile against the entity if the entity is not hostile (also known as friendly).

A missile system may use radar to detect an airborne entity. For instance, the radar may provide data relating to the airborne entity such as speed, altitude, heading, time of measurement, range and/or bearing (where data may be considered to include position if range and bearing are included), etc.

It is noted that radar does not require the cooperation of an airborne entity in order to detect the entity, and therefore may detect the airborne entity even if the airborne entity does not cooperate. However, the data provided by the radar may not necessarily allow the detected entity to be sufficiently identified for the missile system to make a correct decision on whether or not to launch a missile against the detected entity. Moreover, the radar may not necessarily detect all airborne entity/ies. For instance, in some embodiments the radar may be limited in direction.

Optionally, the radar of missile system may include an Identification Friend or Foe ('IFF') system to interrogate an entity detected by the radar. If a response is received, the entity may be identified as friendly. However, it is possible that even if an entity is friendly, no IFF response or an incorrect response may be received, for instance because the entity does not have a transponder, because the entity's transponder is damaged, and/or because there are encryption problems, etc.

SUMMARY

In accordance with the presently disclosed subject matter, there is provided a missile method comprising, determining that Automatic Dependent Surveillance Broadcast ("ADS-B") data relating to an airborne entity was obtained; determining whether or not radar data relating to the airborne entity was obtained; determining whether or not to command missile launch against the airborne entity; and if determined not to command missile launch, then refraining from commanding missile launch against the airborne entity.

In some examples of the method, if radar data relating to the airborne entity was not obtained, then the determining whether or not to command missile launch against the airborne entity includes determining that a missile should not be launched against the airborne entity.

In some examples of the method, the determining whether or not radar data relating to the airborne entity was obtained includes: determining whether or not radar data was obtained; and if radar data was obtained, then determining whether or not the radar data pertains to the airborne entity at least partly based on comparing position data included in the radar data with position data included in the ADS-B data.

In some examples, the method further comprises: if determined to command missile launch, then commanding missile launch against the airborne entity.

In some examples of the method, if determined that radar data relating to the airborne entity was obtained, then the determining whether or not to command missile launch includes: estimating that the entity is not hostile because ADS-B data was obtained; providing to an operator a result of the estimating; and receiving an indication from the operator whether or not a missile should be launched against the airborne entity.

In some examples of the method, if determined that radar data relating to the airborne entity was obtained, then the determining whether or not to command missile launch includes: estimating a likelihood that the entity is not hostile or hostile, including evaluating a likelihood that an identification consistent with a non-hostile entity, included in the ADS-B data, is trustworthy or untrustworthy; providing to an operator a result of the estimating; and receiving an indication from the operator whether or not a missile should be launched against the airborne entity.

In some examples of the method, the determining whether or not to command missile launch includes: estimating that the entity is not hostile because ADS-B data was obtained; and determining that a missile should not be launched.

In some examples of the method, if determined that radar data relating to the airborne entity was obtained, then the determining whether or not to command missile launch includes: estimating a likelihood that the entity is not hostile or hostile, including evaluating a likelihood that an identification consistent with a non-hostile entity, included in the ADS-B data, is trustworthy or untrustworthy; and determining whether or not a missile should be launched against the airborne entity, at least partly based on a result of the estimating.

In some examples of the method, if determined that radar data relating to the airborne entity was obtained, then the determining whether or not to command missile launch includes: providing to an operator an indication that ADS-B data and radar data were obtained for the airborne entity; and receiving an indication from the operator whether or not a missile should be launched against the airborne entity.

In some examples of the method, missile launch is not commanded against the airborne entity if it is estimated that a likelihood of the entity being not hostile is above a predetermined threshold, at least partly based on an evaluation that a likelihood of an identification consistent with a non-hostile entity, included in the ADS-B data, being trustworthy is above a predefined percentage.

In some examples of the method, missile launch is not commanded against the airborne entity because ADS-B data was obtained.

In some examples of the method, the missile is a surface to air missile.

In accordance with the presently disclosed subject matter, there is provided a missile system, comprising: a launch control configured to determine that Automatic Dependent Surveillance Broadcast ("ADS-B") data relating to an airborne entity was obtained, to determine whether or not radar data relating to the airborne entity was obtained, to determine whether or not to command missile launch against the airborne entity, and to refrain from commanding missile launch against the airborne entity if determined not to command missile launch.

In some examples, the system further comprises: an ADS-B receiver.

In some examples, the system further comprises: a missile launcher.

In some examples, the system further comprises: a radar.

In some examples, the system is a surface to air missile system.

In some examples of the system, the launch control is configured to refrain from commanding missile launch against the airborne entity, if it is estimated that a likelihood of the entity being not hostile is above a predetermined threshold, at least partly based on an evaluation that a likelihood of an identification consistent with a non-hostile entity, included in the ADS-B data, being trustworthy is above a predefined percentage.

In some examples of the system, the launch control is configured to refrain from commanding missile launch against the airborne entity because ADS-B data was obtained.

In accordance with the presently disclosed subject matter, there is provided a computer program product, comprising a computer readable medium having computer readable program code embodied therein, the computer program product comprising: computer readable program code for causing the computer to determine that Automatic Dependent Surveillance Broadcast ("ADS-B") data relating to an airborne entity was obtained; computer readable program code for causing the computer to determine whether or not radar data relating to the airborne entity was obtained; computer readable program code for causing the computer to determine whether or not to command missile launch against the airborne entity; and computer readable program code for causing the computer to refrain from commanding missile launch against the airborne entity if determined not to command missile launch.

BRIEF DESCRIPTION OF THE DRAWINGS

In order to understand the subject matter and to see how it may be carried out in practice, non-limiting examples will be described, with reference to the accompanying drawings, in which.

Figure 1:
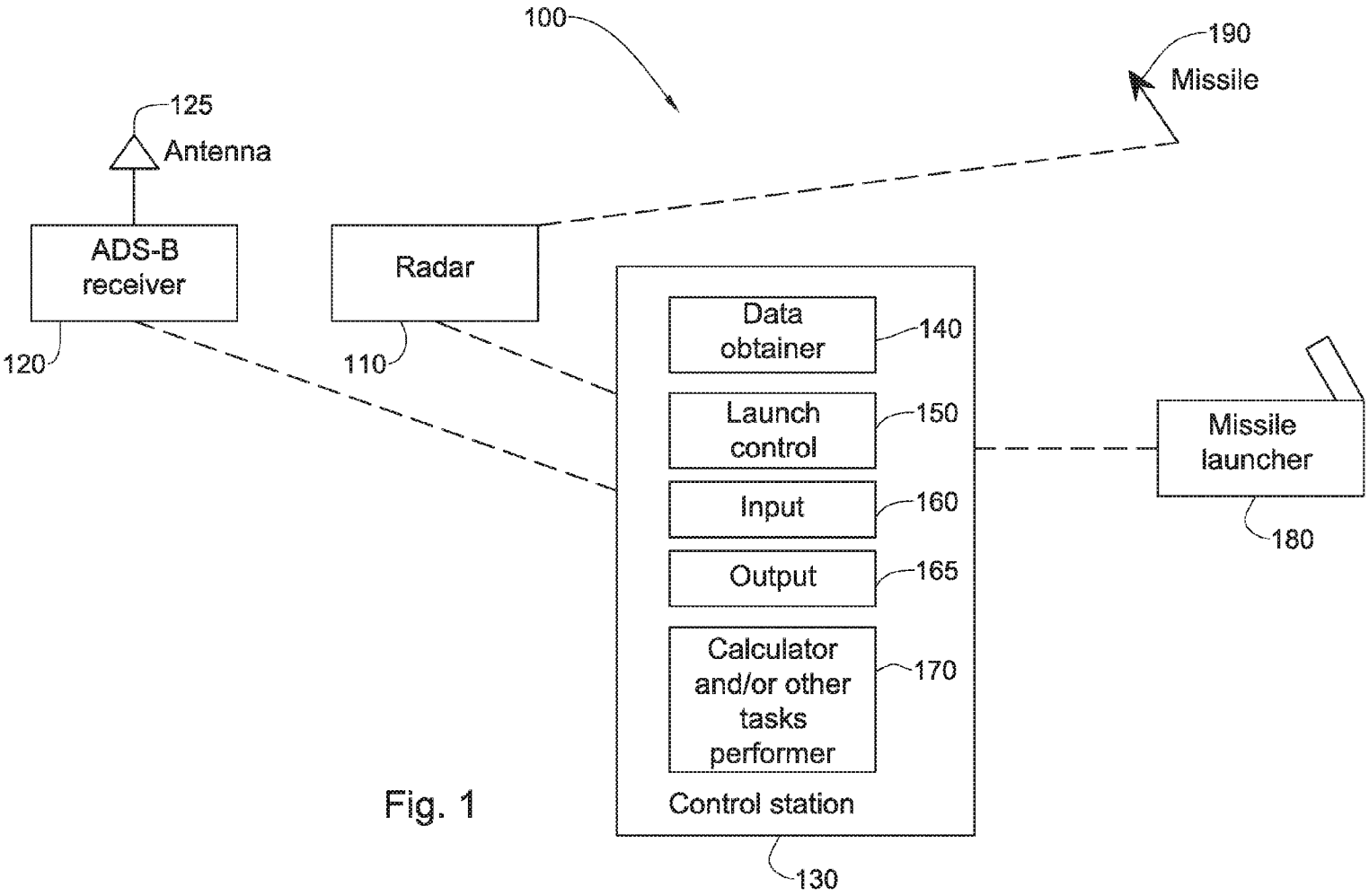
FIG. 1 is a block diagram illustrating an example of a missile system, in accordance with the presently disclosed subject matter.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE DRAWINGS

Described herein is at least one example of a missile system, method, and/or computer program product. The missile system may, for example, include a radar, an Automatic Dependent Surveillance Broadcast ("ADS-B") receiver, a missile launcher, and a control station. The missile system may, for example, be configured to handle various situations such as when only ADS-B data relating to an airborne entity is available, only radar data relating to the airborne entity is available or both ADS-B data and radar data relating to the airborne entity are available. The missile system, may, for example, be a surface to air missile system.

The term airborne entity is used to denote an entity which is in the air. The subject matter does not limit the type of airborne entity. Examples of an airborne entity may include an airplane, helicopter, balloon, spacecraft, missile, unmanned aerial vehicle (UAV), etc.

In the following detailed description, numerous specific details are set forth in order to provide a thorough understanding of the subject matter. However, it will be understood by those skilled in the art that some examples of the subject matter may be practiced without these specific details. In other instances, well-known features, structures, characteristics, stages, methods, modules, elements, and systems have not been described in detail so as not to obscure the subject matter.

Usage of the term "for example," "such as", "for instance", "e.g.", "possibly", "it is possible", "optionally", "say", "one example", "illustrated example", "some examples", "another example", "other examples", "various examples", "examples", "one instance", "some instances", "another instance", "other instances", "instances", "one case", "some cases", "another case", "other cases" "cases", or variants thereof means that a particular described feature, structure, characteristic, stage, method, module, element, or system is included in at least one non-limiting example of the subject matter, but not necessarily in all examples. The appearance of the same term does not necessarily refer to the same example(s).

The term "illustrated example", is used to direct the attention of the reader to one or more of the figures, but should not be construed as necessarily favoring any example over any other.

The term "non-transitory" is used to exclude transitory, propagating signals, but to otherwise include any volatile or non-volatile computer memory technology suitable to the application.

Usage of conditional language, such as "may", "can", "could", or variants thereof is intended to convey that one or more examples of the subject matter may include, while one or more other examples of the subject matter may not necessarily include, certain features, structures, characteristics, stages, methods, modules, elements, and/or systems. Thus such conditional language is not generally intended to imply that a particular described feature, structure, characteristic, stage, method, module, element, or system is necessarily included in all examples of the subject matter.

It should be appreciated that certain features, structures, characteristics, stages, methods, modules, elements, and/or systems disclosed herein, which are, for clarity, described in the context of separate examples, may also be provided in combination in a single example. Conversely, various features, structures, characteristics, stages, methods, modules, elements, and/or systems disclosed herein, which are, for brevity, described in the context of a single example, may also be provided separately or in any suitable sub-combination.

Referring now to the figures, FIG. 1 is a block diagram illustrating an example of a missile system 100, in accordance with the presently disclosed subject matter. The illustrated example shows possible elements of missile system 100.

In the illustrated example, system 100 may include one or more missile launcher(s) 180 configured to launch missile(s). The subject matter does not limit the number of launcher(s) 180 in system 100, the frequency of launching, the number of missile(s) which may be launched at one time by any particular missile launcher 180, the total number of missile(s) which may be launched by any particular missile launcher 180, and/or any other parameter relating to missile launching. For simplicity's sake it is assumed that system 100 includes one launcher 180 which may launch one missile at a time, and therefore one launcher 180 and one launched missile 190 are shown in FIG. 1.

In the illustrated example, system 100 may include an ADS-B receiver 120 and an antenna 125, for instance with a radio connection between receiver 120 and antenna 125. ADS-B receiver 120 may be configured to work with any appropriate ADS-B data link (e.g. VHF, 1090 MHz extended squitter, 978 MHz universal access transceiver, etc), depending on the instance.

ADS-B is a technology which enables an airborne entity to periodically broadcast data relating to the airborne entity such as identification (e.g. flight identification [also known as call sign] typically although not necessarily including name or acronym of a commercial airline and flight number, and/or e.g. address [also known as registration number] typically although not necessarily including a 24 bit code, etc.), position, altitude, speed, heading, and/or time associated with the data, etc. through an onboard ADS-B transmitter. For instance, the airborne entity may receive a current position thereof from conventional Global Navigation Satellite System (GNSS) technology. The broadcasted data may be received by ADS-B receiver(s), e.g. on ground, on ship(s), and/or in other airborne entity/ies.

Depending on the instance, ADS-B receiver 120 may be operatively connected to any other part of system 100, e.g. via a USB connection, a LAN connection, and/or via any other wired or wireless connection.

In the illustrated example, system 100 may include a control station 130 including a data obtainer 140. ADS-B receiver 120 may be connected, for instance, to data obtainer 140 in control station 130. Although ADS-B receiver 120 is illustrated as being external to control station 130 in FIG. 1, in some instances, ADS-B receiver 120 may be part of control station 130.

In the illustrated example, system 100 may include one or more radar(s) 110. For instance the same radar or different radars may be configured to detect an airborne entity and, if a missile (e.g. missile 190) is launched against the airborne entity, to guide the launched missile so as to target the airborne entity. For simplicity of description, radar 110 will be referred to in the single form, and the single form should be construed to cover embodiments where there is only one radar or a plurality of radars. Radar 110 may optionally include an IFF interrogation system, and in this case data obtained from radar 110 may include an IFF response.

Depending on the instance, data obtainer 140 may be configured to obtain data from radar 110 and/or from ADS-B receiver 120. Data that is obtained may be pulled by data obtainer 140 and/or pushed to data obtainer 140. For instance, data obtained from radar 110 ("radar data") may include data relating to an airborne entity such as, speed, altitude, heading, range, bearing (where radar data may be considered to include position if range and bearing are included), and/or time associated with the data, etc. For instance, data obtained from ADS-B receiver 120 ("ADS-B data") may include data relating to an airborne entity such as identification, position, altitude, speed, heading, and/or time associated with the data, etc.

In the illustrated example, control station 130 of system 100 may include a launch control 150. Data obtainer 140 may be configured to provide obtained data to launch control 150. Launch control 150 may be configured to determine if ADS-B data and/or radar data were obtained. For instance, data obtainer 140 may be configured to indicate the source of the data (ADS-B and/or radar) when providing data to launch control 150. If both ADS-B data and radar data were obtained, launch control 150 may be configured to determine whether or not the ADS-B data and the radar data pertain to the same airborne entity, for instance by comparing position data included in the ADS-B data with position data included in the radar data. Additionally or alternatively, if both ADS-B data and radar data were obtained, launch control 150 may be configured to determine whether or not ADS-B data and radar data pertain to the same airborne entity, in any other manner, for instance at least partly based on an indication received from an operator. A received indication may include an input from the operator (e.g. inputted via an input 165) or may include a lack of input from an operator.

Launch control 150 may be configured to determine whether or not to command launch of a missile (e.g. missile 190) by missile launcher 180 against an airborne entity. In some instances, if only ADS-B data was obtained for the airborne entity, then launch control 150 may be configured to determine that a missile should not be launched because of the lack of radar data. Additionally or alternatively, if it is assumed that ADS-B data would only be broadcasted by a non-hostile airborne entity, then in some instances, if ADS-B data was obtained, launch control 150 may be configured to estimate that the entity is not hostile. Additionally or alternatively, in some instances where at least radar data was obtained, in order to determine whether or not to command missile launch, launch control 150 may be configured, at least partly on the basis of data provided by data obtainer 140, to estimate a likelihood that the entity is not hostile and/or to estimate a likelihood that the entity is hostile. Continuing with these instances, if it is assumed for example, that ADS-B data which would be broadcasted by a non-hostile airborne entity would include true data (e.g. true identification consistent with a non-hostile entity) whereas ADS-B data which would be broadcasted by a hostile airborne entity in order to mislead system 100 would include false data (e.g. false identification consistent with a non-hostile entity), then an estimation of a likelihood that the entity is not hostile may e.g. be at least partly based on an evaluation of a likelihood that an identification consistent with a non-hostile entity which is included in the ADS-B data is trustworthy. Additionally or alternatively, in some instances launch control 150 may be configured to provide data (e.g. data obtained by data obtainer 140, an indication that ADS-B and/or radar data was/were obtained, a result of determining whether or not radar and ADS-B data pertain to same entity, and/or a result of estimating, etc.) to an operator, e.g. via an output 165. Additionally or alternatively, in some instances, launch control 150 may be configured to automatically determine whether or not a missile should be launched at least partly based on a result of the estimating. Additionally or alternatively, in some instances launch control 150 may be configured to receive an indication from an operator whether or not a missile should be launched. A received indication may include an input from the operator, e.g. via input 160 or may include a lack of input from the operator.

The subject matter does not limit how identification may be consistent with a non-hostile airborne entity. In some instances, an identification consistent with a non-hostile entity may be recognizable as identifying a non-hostile entity and/or as not identifying a hostile entity by control station 130 and/or by an operator, where the recognition may be based on experience, available data, and/or common knowledge, etc.

In the illustrated example where it is assumed that input may be received from an operator, control station 130 may include input 160. Input 160 may include one or more input device(s) such as keyboard(s), keypad(s), touch-screen(s), and/or microphone(s), etc. In other examples, control station 130 may not include input 160. In the illustrated example where it is assumed that data may be output to an operator, control station 130 may include output 165. Output 165 may include one or more output device(s) such as screen(s), touch-screen(s), and/or speaker(s), etc. In other examples, control station 130 may not include output 165.

In the illustrated example, control station 130 may include a calculator and/or other tasks performer 170 which may be configured to perform calculation and/or other tasks relating to a launched missile. In other examples, control station 130 may not include calculator and/or other tasks performer 170.

Depending on the instance, elements of system 100 may be centralized in one location or elements of system 100 may be dispersed over more than one location. Control station 130 may be located in one location or elements of control station 130 may be dispersed over more than one location. System 100 or any part thereof may be on the ground, on a ship, and/or on an airborne entity, etc. If at least part of system 100 is on the ground, system 100 or any part thereof may be stationary and/or portable (e.g. portable by truck, trailer, and/or person, etc.) If system 100 is on the ground then system 100 may be referred to as a surface to air missile system.

In the illustrated example, the dashed lines may represent possible connections between various elements of system 100. Any two elements may be operatively connected via a wireless and/or wired connection, depending on the instance. Communication via a wireless connection may be by way of microwave signals and/or by way of any other signals.

Alternatively to the example shown in FIG. 1, system 100 may in some examples include fewer, more and/or different elements than shown in FIG. 1. For instance, in some examples input element 160, output element 165, and/or calculator and/or other tasks performer 170 may be omitted. Additionally or alternatively for instance, in some examples elements 140, 150 and/or 170 may be combined into fewer element(s) than illustrated. Additionally or alternatively for instance, in some examples elements 160 and 165 may be combined. Alternatively to the example shown in FIG. 1, the functionality of system 100 may in some examples be divided differently among the elements illustrated in FIG. 1. Therefore, the subject matter does not necessarily limit any particular functionality to the element to which the particular functionality is attributed herein and in some examples, different element(s) may additionally or alternatively provide the particular functionality. For instance, functionality attributed herein to a particular element in control station 130 may be provided by different element(s) in control station 130 in some examples. Alternatively to the example shown in FIG. 1, the functionality of system 100 described herein may in some examples be divided into fewer, more and/or different elements than shown in FIG. 1 and/or system 100 may in some examples include additional, less, and/or different functionality than described herein. For instance in some examples, missile system 100 may include additional and/or alternative functionality relating to missiles.

Figure 2:
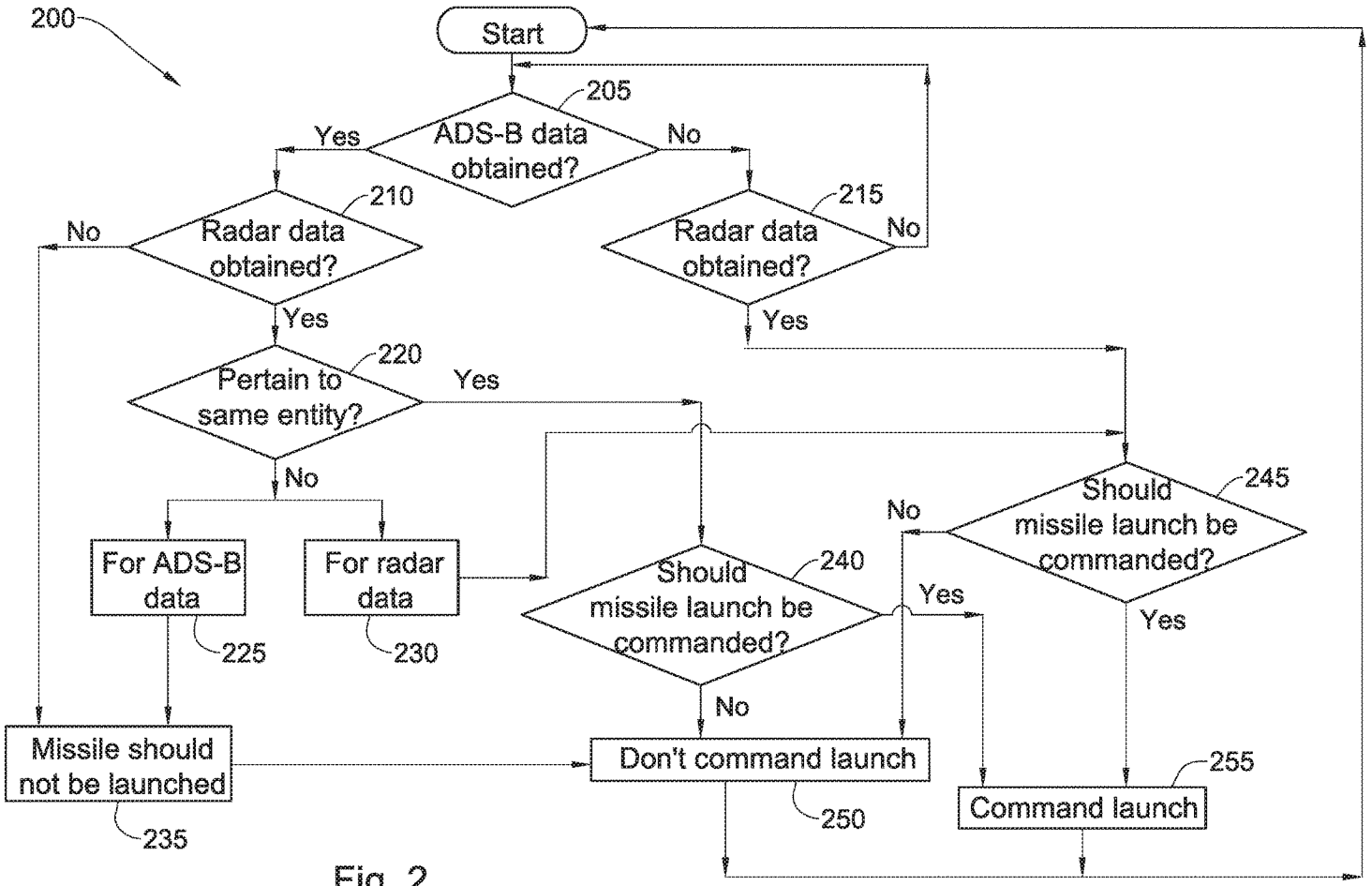
FIG. 2 is a flowchart illustrating an example of a missile method, in accordance with the presently disclosed subject matter.

FIG. 2 is a flowchart illustrating an example of a missile method 200, in accordance with the presently disclosed subject matter. System 100 may in some cases perform method 200.

In the illustrated example, in stage 205, it may be determined whether or not ADS-B data was obtained relating to an airborne entity. For instance ADS-B receiver 120 may have received data broadcasted by the airborne entity. Continuing with this instance, data obtainer 140 may have obtained data from ADS-B receiver 120 and provided the data to launch control 160, indicating to launch control 160 that the data is ADS-B data, thereby enabling launch control 160 to determine that ADS-B data was obtained relating to an airborne entity.

If it is determined in stage 205 that ADS-B data was obtained (yes to stage 205) then in stage 210 it may be determined if radar data relating to an airborne entity was obtained. For instance, radar 110 may have detected an airborne entity. Continuing with this instance, data obtainer 140 may have obtained data from radar 110 and provided the data to launch control 160, indicating to launch control 160 that the data is radar data, thereby enabling launch control 160 to determine that radar data was obtained relating to an airborne entity.

If radar data was obtained (yes to stage 210), then in stage 220 it may be determined, for instance by launch control 160 whether or not the radar data pertains to the (same) airborne entity to which the ADS-B data relates. For instance, position data included in the ADS-B data may be compared to position data included in the radar data. If the position included in the radar data and the position included in the ADS-B data are sufficiently similar (e.g. identical or e.g. one is within a predetermined accuracy range of the other), then it may be determined that the radar data and ADS-B data pertain to the same entity, whereas if the positions are not sufficiently similar then it may be determined that the radar data and ADS-B data do not pertain to the same entity. The predetermined accuracy range is not bound by any particular range, and may vary depending on the instance. In instances where the determination regarding whether or not the radar data and ADS-B data pertain to the same entity includes processing of the radar data and ADS-B data the subject matter does not limit how the processing is performed and depending on the instance, the processing may include comparison of other ADS-B data with other radar data and/or other processing in addition to or instead of comparing position data. Optionally, an operator may be provided with an indication that ADS-B data and radar data were obtained for the same entity or for different entities. For instance, launch control 150 may provide via output 165 an indication of the situation that ADS-B data and radar data were obtained for the same entity e.g. by way of an icon in a particular form and/or color representative of this situation, and/or by way of text descriptive of this situation, etc., or an indication of the situation that ADS-B data and radar data were obtained for different entities e.g. by way of separate icons in a particular form and/or color representative of this situation, and/or by way of text descriptive of this situation, etc.

Additionally or alternatively, launch control 160 may determine whether or not the ADS-B data and radar data pertain to the same entity subsequent to an indication from the operator. For instance, assuming that a comparison of ADS-B data and radar data has taken place, in some cases the comparison may lead to an incorrect conclusion that ADS-B data and radar data relate to different entities rather than to the same entity, for instance due to the different times associated with the ADS-B data and radar data. In some of these cases, an operator may indicate that contrary to the comparison conclusion, the data relates to the same entity or to different entities. For instance, if an indication of the same entity was output to the operator (e.g. one icon and/or text shown indicative of the same entity), the operator may indicate (e.g. via input 160) that the data actually relates to different entities (e.g. indicate that a plurality of icons and/or text descriptive of there being different entities should be shown instead). Similarly if an indication of different entities was output to the operator (e.g. a plurality of icons and/or text shown indicative of different entities), the operator may indicate via input 160 that the data actually relates to the same entity (e.g. indicate that one icon and/or text descriptive of there being the same entity should be shown instead). Similarly, in some cases where the comparison conclusion appears to be correct to the operator, the operator may provide an indication of agreement e.g. by input or lack of input via input 160.

If it is determined that the radar data and ADS-B data do not pertain to the same entity (no to stage 220), then method 200 may continue separately with regard to the ADS-B data (stage 225) and the radar data (stage 230). In the illustrated example, in stage 225, with regard to the ADS-B data, method 200 may proceed to stage 235.

Method 200 may proceed to stage 235 additionally or alternatively if only ADS-B data was obtained but no radar data was obtained (no to stage 210). If no radar data was obtained, then it follows that more specifically no radar data was obtained relating to the airborne entity to which the ADS-B data relates.

In cases where no radar data was obtained relating to the airborne entity to which the ADS-B data relates (e.g. no radar data was obtained for any airborne entity or radar data which was obtained relates to a different entity), the subject matter does not limit the reason for no radar data. For instance, no radar data may have been obtained relating to the airborne entity to which the ADS-B data relates because radar 110 may be limited in direction and therefore may not have detected the airborne entity to which the ADS-B data relates and/or due to any other reason.

Optionally, an operator may be provided with an indication that ADS-B data was obtained relating an airborne entity but no radar data was obtained relating to that airborne entity (either because no radar data was obtained for any airborne entity or because radar data which was obtained relates to a different airborne entity). For instance, launch control 150 may provide via output 165 an indication of the situation that ADS-B data was obtained relating to an airborne entity but no radar data was obtained relating to that airborne entity, e.g. by way of an icon in a particular form and/or color representative of this situation, and/or by way of text descriptive of this situation, etc.

In the illustrated example in stage 235, it may be determined, e.g. by launch control 150, whether or not to command missile launch against the airborne entity. This determination regarding whether or not to command missile launch may include determining that a missile should not be launched, due to the absence of radar data relating to the airborne entity to which the ADS-B data relates. It is assumed in the illustrated example that without radar data a missile could not be guided to target the entity and therefore a missile should not be launched. However, in some examples where a missile could nevertheless be guided, stage 235 may not necessarily include a determination that a missile should not be launched and may possibly include one or more of the cases described with reference to stage 240 but without the benefit of radar data.

In the illustrated example, it is possible that radar data was obtained relating to an airborne entity but no ADS-B data was obtained (yes to stage 215). For instance, no ADS-B data may have been obtained. Examples of a reason why no ADS-B data may have been obtained may include any of the following: because the airborne entity detected by radar 110 may not be equipped with an ADS-B transmitter (e.g. because the entity is hostile, e.g. despite the fact that the entity is not hostile, etc); because the airborne entity is not currently transmitting ADS-B data through an ADS-B transmitter thereof (e.g. because the entity is hostile, e.g. despite the fact that the entity is not hostile, etc), and/or any other reason. In the illustrated example if radar data was obtained but no ADS-B data was obtained, or if both radar data and ADS-B data were obtained but it was determined that the data pertain to different entities and therefore method 200 continues separately for the radar data (stage 230), then in stage 245 it may be determined, e.g. by launch control 150, whether or not to command missile launch against the airborne entity. For instance, stage 245 may include launch control 150 estimating on the basis of radar data a likelihood that the airborne entity is hostile or not hostile and determining whether or not a missile should be launched. Additionally or alternatively for instance, stage 245 may include launch control 150 estimating on the basis of radar data a likelihood that an airborne entity is hostile or not hostile, providing to an operator a result of the estimating (e.g. via output 165), and receiving an indication from an operator whether or not a missile should be launched, where the indication may be an input (e.g. via input 160) or a lack of input. Additionally or alternatively for instance, stage 245 may include launch control 150 providing radar data to an operator (e.g. via output 165), and launch control 150 receiving an indication from an operator whether or not a missile should be launched, where the indication may be an input (e.g. via input 160) or a lack of input. The operator may, for instance, estimate a likelihood that an airborne entity is hostile or not hostile based on the radar data. The operator and/or launch control 150 may be able to estimate a likelihood that an airborne entity is hostile or not hostile based on the radar data, for instance because characteristics of the airborne entity such as kinematics may be obtained from the radar data. Continuing with this instance, a military (potentially hostile) airborne entity may turn faster and/or fly lower than a civilian (presumably non hostile) airborne entity, may fly in a non-civilian air-route, may fly in a restricted zone, and/or may fly in a direction not leading towards an airport, etc.

In the illustrated example, it may be determined whether or not radar data was obtained relating to the airborne entity to which ADS-B data relates. For instance, a determination that radar data was obtained relating to the airborne entity to which the ADS-B data relates may include a determination that radar data was obtained (yes to stage 210, and that the radar data pertains to the same entity as the ADS-B data (yes to stage 220). If it is determined that radar data was obtained relating to the airborne entity to which ADS-B data relates then in the illustrated example in stage 240 it may be determined, e.g. by launch control 150 whether or not missile launch against the airborne entity should be commanded.

In some cases, stage 240 may include launch control 150 estimating that the airborne entity is not hostile because ADS-B data was obtained. For instance, it may be assumed that only a non-hostile airborne entity would broadcast ADS-B data. In some of these cases, stage 240 may also include launch control 150 determining that a missile should not be launched. Additionally or alternatively, in some of these cases, stage 240 may include launch control 150 providing a result of the estimating to the operator, and receiving an indication from the operator whether or not a missile should be launched. For instance, the launch control 150 may provide via output 165 an indication of the situation that ADS-B data and radar data were obtained and due to the obtainment of ADS-B data it is assumed that the airborne entity is not hostile, e.g. by way of an icon in a particular form and/or color representative of this situation, and/or by way of text descriptive of this situation, etc. The operator may indicate that a missile should not be launched (e.g. because the operator agrees that because ADS-B data was obtained the airborne entity could not be hostile, e.g. because the operator thinks that there is a high likelihood that an identification of the airborne entity consistent with a non-hostile entity included in the ADS-B data is trustworthy say due to a profile of the airborne entity, etc.) or that a missile should be launched (e.g. because the operator thinks that the airborne entity is hostile say due to a profile of the airborne entity and irrespective of the ADS-B data, etc.). The operator may indicate for instance by way of input (e.g. via input 160) or a lack of input. Examples relating to a profile of an airborne entity will be discussed further below. An indication by the operator whether or not a missile should be launched may or may not conform to the result of the estimating provided by launch control 150.

Additionally or alternatively, in some cases where the ADS-B data includes an identification consistent with a non-hostile entity, stage 240 may include launch control 150 estimating a likelihood that the airborne entity is not hostile or is hostile, including evaluating a likelihood that the identification is trustworthy or is untrustworthy. The likelihood of the identification being trustworthy may depend on a profile of the airborne entity as will be discussed below. In some of these cases, stage 240 may also include launch control 150 determining whether or not a missile should be launched based on a result of the estimating. For instance, it may be estimated, at least partly based on an evaluation that the likelihood that the identification is trustworthy is above a predefined percentage, that the likelihood of the airborne entity being not hostile is above a predetermined threshold and therefore a missile should not be launched. The predefined percentage is not bound to any particular percentage and may vary depending on the instance. The predetermined threshold is not bound to any particular threshold and may vary depending on the instance. Additionally or alternatively, in some of these cases, stage 240 may include launch control 150 providing a result of the estimating to the operator, and receiving an indication from the operator whether or not a missile should be launched. For instance, launch control 150 may provide via output 165 an indication of this particular situation where ADS-B data and radar data were obtained, where the identification included in the ADS-B data is consistent with a non-hostile entity, and where the likelihood that the airborne entity not being hostile has been estimated, e.g. by way of an icon in a particular form and/or color representative of this situation, and/or by way of text descriptive of this situation, etc. The operator may indicate whether or not the missile should be launched for instance by way of input (e.g. via input 160) or a lack of input. For instance, the operator may indicate that a missile should not be launched (e.g. because the operator relies on the estimation of launch control 150, e.g. because the operator thinks there is a high likelihood that an identification of the airborne entity consistent with a non-hostile entity included in the ADS-B data is trustworthy say due to a profile of the airborne entity, etc) or that a missile should be launched (e.g. because the operator relies on the estimation of launch control 150, e.g. because the operator thinks that the there is a low likelihood that an identification of the airborne entity consistent with a non-hostile entity included in the ADS-B data is trustworthy say due to a profile of the airborne entity, etc). Examples relating to a profile of the airborne entity will be discussed further below. An indication by the operator whether or not a missile should be launched may or may not conform to the result of the estimating provided by launch control 150.

Additionally or alternatively, in some cases, stage 240 may include launch control 150 providing to an operator (e.g. via output 165) an indication that ADS-B data and radar data were obtained, and receiving an indication from the operator whether or not a missile should be launched. Possibly, in some of these cases launch control module 150 may not have estimated that the airborne entity is not hostile or hostile, may not have estimated a likelihood that the airborne entity is not hostile or hostile, and/or may have estimated but not provided a result of the estimating to the operator. The operator may indicate whether or not the missile should be launched, for instance by way of input (e.g. via input 160) or a lack of input. The operator may determine that a missile should not be launched, e.g. because ADS-B data was received and therefore the operator assumes that the airborne entity is not hostile, e.g. because the operator may estimate that the likelihood that the airborne entity is not hostile is above a predetermined threshold at least partly based on an evaluation that the likelihood that an identification consistent with a non-hostile entity (assumed to be included in the ADS-B data) being trustworthy is above a predefined percentage, etc. It should be understood that when referring to the operator, the operator may intuitively grasp if a certain likelihood is above a predefined percentage or a predetermined threshold without necessarily being capable of expressing the percentage or threshold in numerical terminology. The operator may, for instance, rely on a profile of the airborne entity, when evaluating the likelihood that the identification is trustworthy.

Presuming that an identification included in the ADS-B data is consistent with a non-hostile entity, a profile of the airborne entity, determined from ADS-B and/or radar data, may support or belie an assumption that the identification is trustworthy and that therefore the ADS-B data relates to a non-hostile airborne entity. The subject matter does not limit the characteristics of a profile and a profile may include any characteristics depending on the instance, but for the sake of further illustration to the reader, kinematics characteristics will be discussed. For instance, the kinematics of a civilian (presumably non-hostile airborne entity) may typically although not necessarily be different than a military (potentially hostile) airborne entity. Kinematics which may be considered may include any kinematics, of which a few examples are now provided. For example, a military (potentially hostile) airborne entity may turn faster and/or fly lower than a civilian (presumably non hostile) airborne entity, may fly in a non-civilian air-route, may fly in a restricted zone, and/or may fly in a direction not leading towards an airport, etc.

Assume for instance that an airborne entity is actually hostile. In many cases, a hostile airborne entity may not broadcast ADS-B data, and therefore the determination of whether or not missile launch should be commanded may rely on obtained radar data, if any, as discussed above with reference to stage 245. However in some cases, a hostile airborne entity may try to mislead system 100 by broadcasting ADS-B data including a (false) identification consistent with a non-hostile airborne entity. Continuing with these cases the identification may include a call sign and/or registration number of a civilian aircraft such as a commercial airplane. If a profile of the airborne entity, however, includes characteristic(s) of a military aircraft, the identification may not be necessarily be considered to be trustworthy.

If it is determined in stage 240 or 245 that missile launch should not be commanded (no to stage 240 or 245) or subsequent to stage 235, in the illustrated example in stage 250, launch control 150 may refrain from commanding missile launch against the airborne entity and no missile may be launched by missile launcher 180.

If instead it is determined that launch of a missile should be commanded (yes to stage 240 or 245), then in the illustrated example in stage 255 launch control 150 may command launch and missile launcher 180 may launch a missile (e.g. missile 190). Radar 110 and/or calculator (and/or other tasks performer) 170 may assist the missile in targeting the entity.

Subsequent to stage 250 or 255, or if neither radar data nor ADS-B data was obtained (no to stages 205 and 215), then in the illustrated example method 200 iterates to the beginning, waiting for at least radar data or at least ADS-B data to be obtained. Alternatively, in some examples, method 200 may end if method 200 is no longer required.

In some instances, each time ADS-B data and/or radar data is obtained (in stage 205, 210 and/or 215) the remainder of method 200 may be performed. However, in other instances, once ADS-B data and/or radar data is obtained, the remainder of method 200 may not necessarily be performed. For instance, if it is determined that the data pertains to one or more airborne entity/ies for which data was previously obtained (in a previous iteration of method 200) then in some cases, the determination of a previous iteration on whether or not missile launch should be commanded (in stage 235, 240, or 245) may be relied upon to proceed to stage 250 or 255, without necessarily repeating all of the intervening stages of method 200, whereas in other cases the determination of a previous iteration may not necessarily be relied upon.

Alternatively to the example shown in FIG. 2, stages which are shown in FIG. 2 as being executed sequentially may in some examples be executed in parallel and/or stages shown in FIG. 2 as being executed in parallel may in some examples be executed sequentially. Alternatively to the example shown in FIG. 2 method 200 may in some examples include more, fewer and/or different stages than illustrated in FIG. 2. Alternatively to the example shown in FIG. 2, stages may in some examples be executed in a different order than illustrated in FIG. 2. For instance the determination that ADS-B data was obtained (or not) and/or the determination that radar data was obtained (or not) may be performed in any order or simultaneously.

It will also be understood that the subject matter contemplates that a system or any part of a system disclosed herein may for example, include and/or be included in a computer. For instance, control station 130 or any part thereof, may for example, include a computer and/or be included in a computer. The term "computer" should be expansively construed to cover any kind of system which has data processing capabilities and which may be made up of any combination of hardware, software and/or firmware including at least some hardware. Likewise, the subject matter contemplates, for example, a computer program being readable by a computer for executing a method or part of a method disclosed herein. Further contemplated by the subject matter, for example, is a computer-readable medium tangibly embodying program code readable by a computer for executing a method or any part of a method disclosed herein.

While examples of the subject matter have been shown and described, the subject matter is not thus limited. Numerous modifications, changes and improvements within the scope of the subject matter will now occur to the reader.

The invention claimed is:

1. A method comprising, determining that Automatic Dependent Surveillance Broadcast ("ADS-B") data relating to an airborne entity was obtained;

determining whether or not radar data relating to the airborne entity was obtained;

determining whether or not to command missile launch against the airborne entity at least partly based on said determination that ADS-B data was obtained and at least partly based on said determination whether or not radar data was obtained; and if determined not to command missile launch, then refraining from commanding missile launch against the airborne entity; and if determined to command missile launch, then commanding missile launch against the airborne entity.

2. The method of claim 1, wherein if radar data relating to the airborne entity was not obtained, then said determining whether or not to command missile launch against the airborne entity includes determining that a missile should not be launched against the airborne entity.

3. The method of claim 1, wherein said determining whether or not radar data relating to the airborne entity was obtained includes:

determining whether or not radar data was obtained; and if radar data was obtained, then determining whether or not said radar data pertains to the airborne entity at least partly based on comparing data included in said radar data with data included in said ADS-B data.

4. The method of claim 1, wherein if determined that radar data relating to the airborne entity was obtained, then said determining whether or not to command missile launch includes:

estimating that said entity is not hostile because ADS-B data was obtained;

providing to an operator a result of said estimating; and receiving an indication from the operator whether or not a missile should be launched against the airborne entity.

5. The method of claim 1, wherein if determined that radar data relating to the airborne entity was obtained, then said determining whether or not to command missile launch includes:

estimating a likelihood that said entity is not hostile or hostile, including evaluating a likelihood that an identification consistent with a non-hostile entity, included in said ADS-B data, is trustworthy or untrustworthy;

providing to an operator a result of said estimating; and receiving an indication from the operator whether or not a missile should be launched against the airborne entity.

6. The method of claim 1, wherein said determining whether or not to command missile launch includes:

estimating that said entity is not hostile because ADS-B data was obtained; and determining that a missile should not be launched.

7. The method of claim 1, wherein if determined that radar data relating to the airborne entity was obtained, then said determining whether or not to command missile launch includes:

estimating a likelihood that said entity is not hostile or hostile, including evaluating a likelihood that an identification consistent with a non-hostile entity, included in said ADS-B data, is trustworthy or untrustworthy; and determining whether or not a missile should be launched against the airborne entity, at least partly based on a result of said estimating.

8. The method of claim 1, wherein if determined that radar data relating to the airborne entity was obtained, then said determining whether or not to command missile launch includes:

providing to an operator an indication that ADS-B data and radar data were obtained for the airborne entity; and receiving an indication from the operator whether or not a missile should be launched against the airborne entity.

9. The method of claim 1, wherein missile launch is not commanded against the airborne entity if it is estimated that a likelihood of said entity being not hostile is above a predetermined threshold, at least partly based on an evaluation that a likelihood of an identification consistent with a non-hostile entity, included in said ADS-B data, being trustworthy is above a predefined percentage.

10. The method of claim 1, wherein missile launch is not commanded against the airborne entity because ADS-B data was obtained.

11. The method of claim 1, wherein said missile is a surface to air missile.

12. A missile system, comprising:

a launch control configured to determine that Automatic Dependent Surveillance Broadcast ("ADS-B") data relating to an airborne entity was obtained, to determine whether or not radar data relating to the airborne entity was obtained, to determine whether or not to command missile launch against the airborne entity at least partly based on the determination that ADS-B data was obtained and at least partly based on the determination whether or not radar data was obtained, and to refrain from commanding missile launch against the airborne entity if determined not to command missile launch and to command missile launch against the airborne entity if determined to command missile launch.

13. The system of claim 12, further comprising: an ADS-B receiver communicatively connected to the launch control and configured to obtain ADS-B data.

14. The system of claim 12, further comprising: a missile launcher communicatively connected to the launch control and configured to launch a missile.

15. The system of claim 14, wherein said missile is a surface to air missile.

16. The system of claim 12, further comprising: a radar communicatively connected to the launch control and configured to obtain radar data.

17. The system of claim 12, wherein said launch control is configured to refrain from commanding missile launch against the airborne entity, if it is estimated that a likelihood of said entity being not hostile is above a predetermined threshold, at least partly based on an evaluation that a likelihood of an identification consistent with a non-hostile entity, included in said ADS-B data, being trustworthy is above a predefined percentage.

18. The system of claim 12, wherein said launch control is configured to refrain from commanding missile launch against the airborne entity because ADS-B data was obtained.

19. A computer program product, comprising a non-transitory, computer readable medium having computer readable program code embodied therein, the computer program product comprising:

computer readable program code for causing the computer to determine that Automatic Dependent Surveillance Broadcast ("ADS-B") data relating to an airborne entity was obtained;

computer readable program code for causing the computer to determine whether or not radar data relating to the airborne entity was obtained;

computer readable program code for causing the computer to determine whether or not to command missile launch against the airborne entity at least partly based on the determination that ADS-B data was obtained and at least partly based on the determination whether or not radar data was obtained; and computer readable program code for causing the computer to refrain from commanding missile launch against the airborne entity if determined not to command missile launch; and computer readable program code for causing the computer to command missile launch against the airborne entity if determined to command missile launch.

20. The system of claim 12, wherein said launch control is configured to, if radar data was obtained, determine whether or not said radar data pertains to the airborne entity at least partly based on comparing data included in said radar data with data included in said ADS-B data.

* * * * *